US005363176A

United States Patent [19]

Ishihara et al.

[11] Patent Number: 5,363,176

[45] Date of Patent: Nov. 8, 1994

[54] CONTACT CHARGING MEMBER AND APPARATUS USING THE CHARGING MEMBER

[75] Inventors: Yuzi Ishihara; Hisayo Ito, both of Kawasaki, Japan

[73] Assignee: Canon Kabushiki Kaisha, Tokyo, Japan

[21] Appl. No.: 186,881

[22] Filed: Jan. 26, 1994

Related U.S. Application Data

[63] Continuation of Ser. No. 77,387, Jun. 17, 1993, abandoned.

[30] Foreign Application Priority Data

Jun. 26, 1992 [JP] Japan ..... 4-169405

[51] Int. Cl.[5] ..... G03G 15/02

[52] U.S. Cl. ..... 355/219; 361/225; 492/53; 492/56

[58] Field of Search ..... 355/219, 200, 210; 361/225; 430/35, 902; 492/28, 53, 56

[56] References Cited

U.S. PATENT DOCUMENTS 5,017,965 5/1991 Hashimoto et al. ..... 355/219

5,140,371 8/1992 Ishihara et al. ..... 355/313

*Primary Examiner*—R. L. Moses

*Attorney, Agent, or Firm*—Fitzpatrick, Cella, Harper & Scinto

[57] ABSTRACT

A charger having a surface layer, the content of components of the surface layer having a molecular weight of 1,000 or less in a resin is 0.5 wt % or less, charges a member to be charged by contacting the member to be charged in an electrophotographic apparatus or the like.

18 Claims, 2 Drawing Sheets

CONTACT CHARGING MEMBER AND APPARATUS USING THE CHARGING MEMBER

This application is a continuation of application Ser. No. 08/077,387, filed Jun. 17, 1993, now abandoned.

BACKGROUND OF THE INVENTION

1. Field of the Invention

This invention relates to a charging member for use in an electrophotographic apparatus or the like and, more particularly, to a charging member which is used to charge a member to be charged bringing into contact the member to be charged with a voltage applied to the charging member.

2. Description of the Related Art

The image forming process of an image forming apparatus, such as an electronic copying machine or an electrostatic recording machine, includes a step of uniformly charging a member to be charged, and a contact charging method is known as a charging means used for such a charging step. To achieve a uniform charging effect in the contact charging method, it is necessary that the member to be charged and the charged member contact uniformly with each other. Therefore, the charging member has an elastic layer with slight rigidity. It is necessary to add a large amount of an oil-like component to a high molecular compound such as rubber or thermoplastic elastomer in order to obtain a slightly rigid elastic member. However, the charged member may be contaminated by the oil-like component exuding from the compound, and the adhesion between the charged member and the charging member may become so large that the charged member cannot function normally or, in a worst case, a surface of the photosensitive layer of the charged member is separated. If there is a need to accurately control the charged condition of the charged member surface, it is necessary to accurately control the conductivity of the charging member surface. In the case of the above-described method, however, the conductivity cannot be suitably controlled and there is a possibility of an occurrence of image defects in the form of a dot or a line. To solve these problem, a surface which contacts the charged member may be formed on the charging member surface. It is also necessary for this surface layer to have a certain elasticity such that the surface layer can suitably follow a slightly rigid elastic layer formed under the surface layer. A material having a high molecular compound as a binder resin is ordinarily used to form the surface layer.

However, a resin of a high molecular compound, obtained by a polymerization reaction of one or several monomers, contains residual low molecular compounds, such as an unreacted monomer, and residual polymerization initiator, a catalyst, an oligomer component, and such components other than the high molecular component move to the charged member surface. That is, if such a surface layer is formed on the charging member, the contamination of the charged member with a substance moving from the inner layer of the charging member the adhesion between the charging member and the charged member can be presented and the charged condition of the charged member surface can be accurately controlled. Nevertheless the surface layer itself acts as a contamination source to reduce the uniformity of charging and, also causes a chemical or physical change in the charged member. In addition this effect is particularly high under a high-humidity condition.

SUMMARY OF THE INVENTION

In view of the above-described problems, an object of the present invention is to provide a charging member which operates to restrict a contaminative effect resulting from a move of an oil-like component from an inner layer, and to provide a charging member with a small adhesion to a charged member such that no considerable deterioration is caused in the characteristics of the charged member, and which enables the charged condition of a surface of the charged member to be accurately controlled, and to provide a charging member an apparatus using such a charging member.

To achieve this object, according to the present invention, there is provided a charging member using a surface resin (which has a content of low molecular components having a molecular weight of 1,000 or less is 0.5 wt % or less).

DESCRIPTION OF THE PREFERRED EMBODIMENT

Figure 1:
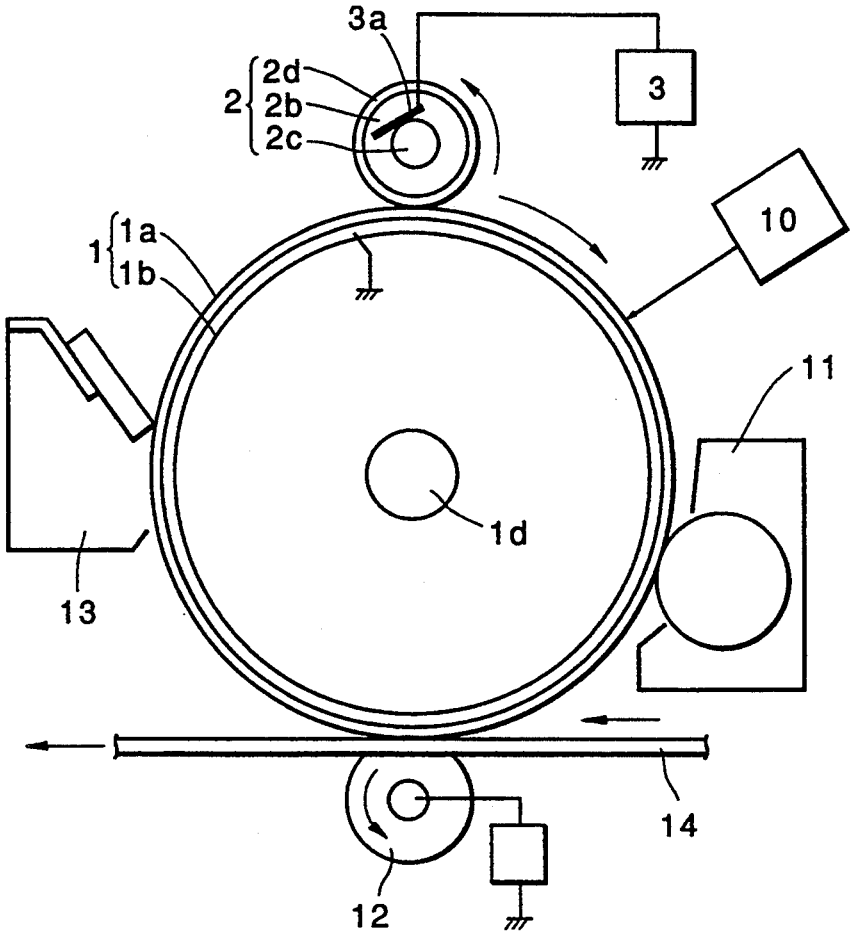
FIG. 1 is a schematic diagram of an ordinary transfer type electrophotographic apparatus using a charging member in accordance with the present invention.

A charging member in accordance with the present invention is generally formed of an electroconductive base and an elastic layer formed on the base. A protective layer is formed on the elastic layer if necessary.

A material having a sufficiently high strength can be used as the material of the electroconductive base. Iron, stainless steel, aluminum, and an electroconductive plastic or the like is preferred as such a material. The shape of the base may be selected from various shapes, such as the shapes of a roll, a flat plate, a block, and the like.

A resin component forming the elastic layer may be selected from suitable high molecular materials, e.g., rubbers, such as ethylene-propylene-diethane-terpolymer (EDPM), polybutadiene, natural rubber, polyisoprene, styrene-butadiene rubber (SBR), chloroprene rubber (CR), nitryl-butadiene rubber (NBR), silicone rubber, urethane rubber and epichlorohydrin rubber, butadiene resins (RB), thermoplastic elastomers of polystyrene family, such as styrene-butadiene-styrene copolymer (SBS), styrene-ethylene-butylene-styrene copolymer (SEBS) and styrene-isoprene-styrene copolymer (SIS), thermoplastic elastomers of polyolefin family, polyester family, polyurethane family and polyvinyl dichloride (PVD), polyurethane, polystyrene, polyethylene (PE), polypropyrene (PP), polyvinyl chloride (PVC), acrylic resins, styrene-polyvinyl acetate copolymer, and butadiene-acrylonitrile copolymer.

A resin component forming the surface layer may be selected from suitable high molecular materials, e.g., polyurethane, acrylic resins, such as polymethyl methacrylate and polubutyl methacrylate, polyvinyl butyral, polyvinyl acetal, polyarylate, polycarbonate, polyester, phenoxy resins, polyvinyl acetate, polyvinyl pyridine, cellulose resins, polyvinyl alcohol, polyamide resins, butadiene resins, fluorine resins, silicone resins, and polystyrene-family polyolefin-family thermoplastic elastomers, such as SBS, SIS and SEBS. If the surface layer is formed by applying a coating material, polyurethane resins, acrylic resins, polyester resins, fluorine resins and polyamide resins are particularly preferred because they are suitable for forming a coating material.

To set the content of resin components having a molecular weight of 1,000 or less to 0.5 wt % or less in the resin for forming the surface layer of the charging member, the resin is purified, for example, by either (1) a method of suitably controlling polymerization conditions, (2) a method of drying a solvent of the resin and processing the resin at a high temperature, or (3) a method of mixing a resin solution in a bad solvent of the resin and precipitating the resin. In method 1, polymerization conditions, such as concentration of a polymerization initiator, the and the reaction time, are selected and unpolymerized low-molecular components are reduced by increasing the polymerization degree. In method 2, a resin is dried and then heated at a temperature immediately below the temperature at which the resin is degenerated to evaporate monomer components and low molecular components. In method 3, a resin in a bad solvent is precipitated to be purified. Among these methods, method 3 is most effective in removing low-molecular components. However, it is noted that the present invention is not limited to these methods.

The content of resin components having a molecular weight of 1,000 or less in the resin for forming the surface layer of the charging member is set to, preferably, 0.3 wt % or less in producing an image of higher qualities.

The surface layer is formed by a suitable method, e.g., a method of preparing a coating material formed of the above-described resin and applying the coating material to the base, or a method of previously forming the resin into a shape generally similar to that of the base and having a size slightly larger than that of the base and superposing the formed resin on the base. Needless to say, the surface layer may be formed so as to have a single layer structure or a multilayer structure. Accordingly, the charging member can be formed into any shape, e.g., the shape of a roller or a flat plate.

An agent for providing a conductivity may be added to the resin according to one's need. Examples of such an agent are carbon black, graphite, carbon fiber, metallic oxides, such as titanium oxide, tin oxide and zinc oxide, and powders of metals, such as gold, silver, copper and nickel. One of these materials or a combination of two or more of them may be used.

The charging member in accordance with the present invention is used for any type of charging control as well as primary charging and transfer charging.

In accordance with the present invention, the charging member formed in this manner is used in various types of electrophotographic apparatus.

FIG. 1 is a schematic cross-sectional view of an electrophotographic apparatus using a charging member 2 in accordance with an embodiment of the present invention.

A photosensitive member 1 is provided as an image carrier, i.e., a drum type electrophotographic photosensitive member having two constitutional layers: an electroconductive base layer of aluminum or the like, and a photoconductive layer 1*a* formed on the circumferential surface of the base layer. The photosensitive member 1 is driven to rotate on a supporting shaft 1*d* clockwise as shown in FIG. 1 and at a predetermined peripheral speed.

The charging member 2 serves to uniformly charge a surface of the photosensitive member 1 to a predetermined voltage with a predetermined polarity by being brought into contact with the surface of photosensitive member 1. In this embodiment, the charging member 2 is of a roller type. The charging member 2 will be hereinafter referred to as "charging roller". The charging roller 2 has a a central metallic core 2*c*, an elastic layer 2*b* formed on the circumferential surface of the metallic core 2*c*, and a protective layer 2*d* formed on the circumferential surface of the elastic layer 2*b*. The charging roller 2 is disposed parallel to the photosensitive member 1 with opposite end portions of the metallic core 2*c* rotatably supported on bearing members (not shown). The charging roller 2 is pressed against the photosensitive member 1 surface with a predetermined pressing force by a pressing means such as a spring, not shown and rotates by being driven with the rotational drive of photosensitive member 1.

In the thus-constructed electrophotogaphic apparatus, a predetermined direct current (DC) bias or a direct current+alternating current (AC+DC) current is applied from a power source 3 to the metallic core 2*c* through a slide electrode 3*a* to charge the circumferential surface of the rotary photosensitive member 1 to a predetermined voltage with a predetermined polarity in a contact charging manner.

The photosensitive member 1 surface uniformly charged through the charging member 2 then undergoes exposure (laser beam scanning exposure, slit-exposure to an original image) effected by an exposure means 10 to receive desired image information. An electrostatic latent image corresponding to the desired image information is thereby formed on the circumferential surface of the photosensitive member 1. The latent image is successively changed into a visible image as a toner image by a development means 11.

Then, the toner image is successively transferred, by a transfer means 12, to a surface of a transfer sheet 14 which is transported from a sheet feed section (not shown) to a transfer section between the photosensitive member 1 and the transfer means by a suitable timing in synchronization with the rotation of the photosensitive member 1. The transfer means 12 in this embodiment is a transfer roller through which the transfer sheet 14 is charged from the reverse side with a polarity opposite to that of the toner so that the toner image on the photosensitive member 1 is transferred to the obverse surface of the transfer sheet 14. It is effective to use the charging member of the present invention for this transfer means.

The transfer sheet to which the toner image has been transferred is separated from the photosensitive member 1 surface, and is transported to an image fixation means (not shown) to fix the image undergo image fixation. The transfer member 14 on which the image is fixed is outputted as an image-printed object or transported to the transfer section again by a re-transportation means if another image is to be formed on the reverse surface.

The surface of the photosensitive member 1 after the image transfer is cleaned by removing residual toner and other attached contaminants by a cleaning means 13 to be repeatedly used for image formation.

The charging member 2 is not limited to the roller type of image carrier 1 charging means provided in the image forming apparatus shown in FIG. 1, and may be formed as a blade type, a block type, a rod type, a belt type, or the like.

The charging member 2 may be driven with the charged member 1 which is driven for surface movement, may be arranged as a non-rotative type, or may be driven to rotate positively at a predetermined peripheral speed in the normal or reverse direction with respect to the direction of surface movement of the charged member 1.

In the electrophotographic apparatus, two or more of the above-described components including the photosensitive member, the development means, and the cleaning means may be integrally combined to form a unit detachable from the apparatus body. For example, at least one, two or all of the charging means, the development means and the cleaning means may be supported integrally with the photosensitive member to form a single unit which is detachably affixed to the apparatus body by using a guide means such as rails on the apparatus body. In this case, the charging means and/or the development means may be constructed on the unit.

If the electrophotographic apparatus is used as a copying machine or a printer, optical image exposure is effected in such a manner that the photosensitive member is irradiated with reflection light or transmission light from an original, or a signal is formed by reading an original with a sensor and scanning with a laser beam or driving an LED array or a liquid crystal shutter array is performed in accordance with this signal to irradiate the photosensitive member with light.

Figure 2:
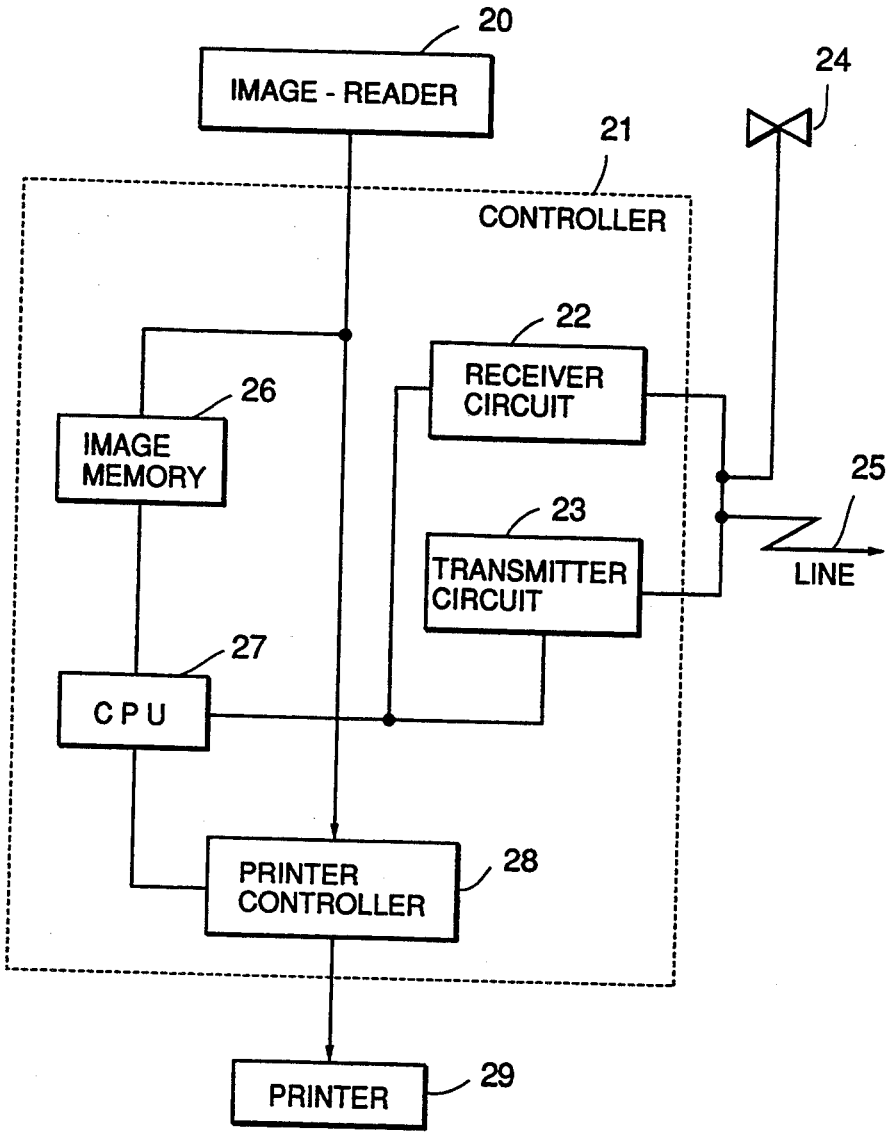
FIG. 2 is a block diagram of a facsimile machine in which an electrophotographic apparatus using a charging member in accordance with the present invention is used as a printer.

If the electrophotographic apparatus is used as a facsimile printer, optical image exposure is effected to print received data. FIG. 2 is a block diagram of such an example of this application.

A controller 21 controls an image reader 20 and a printer 29. The whole operation of the controller 21 is controlled by a CPU 27. Data read from the image reader is transmitted to a terminal on the other end of a line through a transmitter circuit 23. Data received from the terminal on the other end of the line is sent to the printer 29 through a receiver circuit 22. Predetermined image data is stored in an image memory 26. A printer controller 28 controls the printer 29. A telephone 24 is connected to the controller 21.

Image signal received through a line 25 (image information from a remote terminal connected through the line) is demodulated by the receiver circuit 22. Image information thereby obtained is decoded by the CPU 27 and is successively stored in the image memory 26. When image information corresponding to at least one page is stored in the memory 26, the corresponding image is recorded. The CPU 27 reads out one-page image information from the memory 26 to form composite one-page image information and sends the same to the printer controller 28. The printer controller 28 controls the printer 29 to record the image in accordance with the one-page image information received from the CPU 27.

The CPU 27 receives information on the next page during the recording effected by the printer 29.

Image receiving/recording is performed in the above-described manner. The electrophotographic photosensitive member is formed as described below.

A photosensitive layer is formed on an electroconductive supporting member. The electroconductive supporting member may be formed of a material having a conductivity, e.g., aluminum, an aluminum alloy, stainless steel, or nickel, can be used. Alternatively, the electroconductive supporting member may be a plastic member having a coating layer formed of aluminium, an aluminum alloy, indium oxide-tin oxide alloy or the like by vacuum deposition, a metallic or plastic member to which electroconductive particles (e.g., carbon black or tin oxide particles) are applied together with a suitable binder, a plastic member containing an electroconductive binder, or the like.

An undercoating layer having a barrier function and an adhesive function may be provided between the electroconductive supporting member and the photosensitive layer. Examples of the material of this undercoating layer are casein, polyvinyl alcohol, nitrocellulose, polyamides (nylon 6, nylon 66, nylon 610, copolymerized nylon and the like), polyurethane, gelatin and aluminum oxide. The thickness of the undercoating layer is preferably 5 μm or less and, more preferably, 0.5 to 3 μm. To function suitably, it is desirable for the undercoating layer to have a resistivity of $10^7$ Ω.cm or larger.

The photosensitive layer can be formed by applying an organic or inorganic photoconductive material and, if necessary, a binder resin, or may be formed by deposition.

Preferably, the photosensitive layer is a function separation type laminated photosensitive layer having a charge generation layer and a charge transport layer.

The charge generation layer can be formed by depositing a charge generating material, such as an azo pigment, a phthalocyanine pigment, a quinone pigment, or a perylene pigment, or applying such a charge generating material together with a suitable binder resin (or applying only a charge generating material).

The thickness of the charge generation layer is, preferably, 0.01 to 5 μm and, particularly preferably, 0.05 to 2 μm.

The charge transport layer can be formed by dissolving a charge transporting material, such as a hydrazone compound, a styryl compound, an oxazole compound or a triaryl amine compound in a binder resin having a film forming property.

The thickness of the charge transport layer is, preferably, 5 to 50 μm and, particularly preferably, 10 to 30 μm. A protective layer may be provided on the photosensitive layer to prevent the photosensitive layer from deteriorating by ultraviolet rays or the like.

EXAMPLES

Example 1

A layer of an ethylene propylene diene rubber (hereinafter referred to as EPDM) compound composed as shown below was formed around a metallic core having an outside diameter of 6 mm and a length of 240 mm while being vulcanized. A rubber roller having an elastic surface length of 225 mm and an outside diameter of 12 mm was thereby formed.

The EPDM compound was composed of 100 parts by weight of EPDM, 8 parts by weight of conductive carbon black, 40 parts by weight of paraffine oil, 5 parts by weight of zinc oxide, 1 part by weight of a higher fatty acid, 2 parts by weight of sulfur, 1 part by weight of N-cyclohexyl-2-benzothiazylsulfenamido (CBS), which is a vulcanization accelerator, 1 part by weight of tetramethylthiuram disulfide (TMTD), which is also a vulcanization accelerator, and 0.5 part by weight of zinc di-n-butyldithiocarbamate (ZnBDC), which is also a vulcanization accelerator.

A coating material for forming a surface layer on the roller was prepared as described below.

First, as a binder resin used to form the surface layer, a methylolated nylon was synthesized by a process described below.

Nylon 6 was composed by introducing ε-caprolactam, water, benzoic acid and ε-aminocaproic acid and by maintaining these materials in a nitrogen flow at 240° C. for 5 hours. The nylon 6 was dissolved in formic acid, and formaldehyde and methanol were added to the solution in the presence of a phosphoric acid catalyst. The solution was left one day, was thereafter poured into a water-acetone mixture solution, and was neutralized with ammonia. A precipitate of a polymer was thereby obtained. This precipitate was washed with hot water and dried, thereby obtaining a methylolated nylon at a methylolation rate of 30%.

50 g of methylolated nylon obtained in this manner was dissolved in methanol to form a 10% solution. An amount of methyl ethyl ketone (MEK) about 10 times the amount of methanol was added to this solution while the solution was being agitated. A precipitate thereby formed was extracted by filtration, sufficiently washed with MEK, and dried, thereby obtaining purified methylolated nylon. 15 parts by weight of the obtained purified methylolated nylon was dissolved in 85 parts by weight of methanol to form a surface layer coating material.

This coating material was applied to the rubber roller by dipping application to form a nylon surface layer having a thickness of 10 μm. The roller with the surface layer was thereafter dried by being left in an atmosphere at 120° C. for 1 hour. A charging roller having a surface layer formed of the purified methylolated nylon was thereby obtained. This charging roller was mounted at a primary charger position in a page printer LBP-A4 (a product from Canon Inc.) and was operated to perform charging with application of a bias having a direct current voltage $V_{DC}=-550$ V, an alternating current voltage $V_{AC}=1.8$ kVpp and an alternating frequency f=150 Hz. Charging was thereby performed stably with respect to first to 1,000th sheets. The charging roller in the state of being mounted in the cartridge was left in a 40° C., 95% RH atmosphere for two weeks (high moistening storage). A good image was obtained by using the charging roller after this storage. It was confirmed that the characteristics of the charging roller could be stably maintained for a long period of time even under a high-humidity condition.

The molecular weight of the nylon used to form the surface layer was measured. It was found that the content of components having a molecular weight of 1,000 or less was 0.24 wt % while the methylolated nylon having a number-average molecular weight of 40,000 existed as a main component.

The molecular weight was measured by a gel permeation chromatography (GPC) under the following conditions:

(1) temperature: 23° C.
(2) flow velocity: 0.5 ml/min.
(3) solvent: methanol
(4) specimen concentration: 0.1%
(5) pour: 0.3 ml
(6) column: (commercial name: Asahi Pack GS-520M, a product from Asahi Glass Co., Ltd.)

Comparative Example 1

A charging roller was formed and tested in the same manner as Example 1 except that the content of components having a molecular weight of 1,000 or less in the purified methylolated nylon used was 0.7 wt %. Charging was thereby performed stably with respect to first to 1,000. However, it was found that, in some images formed after high moistening storage of the charging roller, a line corresponding to the charging roller contact position was formed and the image quality was considerably reduced.

Example 2

The EPDM compound used in Example 1 was vulcanized and formed into the shape of a flat plate having a thickness of 1.5 mm, a width of 20 mm and a length of 250 mm. This flat rubber plate was bonded to a steel plate provided as an electroconductive rigid supporting member to form a rubber blade. A coating material formed of 15 parts by weight of a methylolated nylon, 0.4 part by weight of carbon black, and 85 parts by weight of methanol was applied to a surface of this rubber blade to a thickness of 10 μm. A charging blade having a surface layer formed of the purified methylolated nylon was thereby obtained. This charging blade was set so that the blade free length (the distance between a blade supporting member fore edge and a portion of the blade in contact with a drum provided as a photosensitive member) was 10 mm, the contact angle with respect to the drum (the angle formed between the blade fore edge and a segment of a drum tangential line on the drum surface movement downstream side of the point on the drum at which the blade contacts the drum on this tangential line) was 10° and the contact pressure was 20 g/cm. In this state, charging was performed with application of the same bias as that in Example 1. The charging was performed stably with respect to 2,000 sheets. Further, a good image was obtained after high moistening storage of the charging blade. It was confirmed that the characteristics of the charging blade could be stably maintained for a long period of time even under a high-humidity condition. The molecular weight of the nylon used to form the surface layer was measured by the same method as that in Example 1. It was found that the content of components having a molecular weight of 1,000 or less was 0.27 wt % while the methylolated nylon having an average molecular weight of 40,000 existed as a main component.

Example 3

Butylene adipate provided as a polyol component, 1.4-butanediol provided as a chain extender, and diphenylmethane-4.4'-di-isocyanate were mixed at a molar ratio of 1:1:2 and caused to react with each other. Polyester-family polyurethane elastomer (TPU) (specific gravity: 1.3, JISA hardness: 80°) was thereby composed.

50 g of the TPU was dissolved in dimehylformamide (DMF) to form a 10% solution. An amount of MEK about 10 times the amount of DMF was added to this solution while the solution was being agitated. A precipitate thereby formed was extracted by filtration, sufficiently washed with MEK, and dried, thereby obtaining purified polyurethane elastomer. A coating material formed of 5 parts by weight of the obtained purified polyurethane elastomer, 50 parts by weight of conductive tin oxide, and 95 parts by weight of DMF was prepared. This protective layer coating material was applied to the rubber roller formed in accordance with Example 1 to a thickness of 10 μm. A charging roller having a surface layer formed of the purified polyurethane elastomer was thereby obtained. This charging roller was used to perform charging with application of the same bias as that in Example 1. The charging was performed stably with respect to first to 2,000 sheets. Further, a good image was obtained after high moistening storage of the charging roller. It was confirmed that the characteristics of the charging roller could be stably maintained for a long period of time even under a high-humidity condition.

The molecular weight of the polyurethane elastomer used to form the surface layer was measured by the same method as that in Example 1 except that DMF was used as a solution and Asahi Pack GS-510M (product of Asahi Glass) was used as a column. It was found that the content of components having a molecular weight of 1,000 or less was 0.18 wt % while the polyurethane having an average molecular weight of 50,000 existed as a main component.

Comparative Example 2

A charging roller was formed and tested in the same manner as Example 3 except that the content of components having a molecular weight of 1,000 or less in the purified polyurethane elastomer was 0.55 wt %. Charging was thereby performed stably with respect to first to 1,000 sheets. However, it was found that, in some images formed after high moistening storage of the charging roller, a line corresponding to the charging roller contact position was formed and the image quality was considerably reduced.

Example 4

The purified methylolated nylon coating material used in Example 1 was applied by dipping application to a metallic core which has an overall length of 240 mm and in which the outside diameter of outer portions extending through 15 mm from the opposite ends was 6 mm while the inside diameter of an inner portion between the outer portions was 12 mm to form a polyamide surface layer having a thickness of 60 mm. The metallic core with the surface layer was thereafter dried by being left in a 120° C. atmosphere for 1 hour. A charging roller having only a layer of the purified nylon on its surface was thereby obtained. This charging roller was tested and evaluated in the same manner as Example 1. Charging was performed with this charging roller stably with respect to first to 1,000th sheets. Also, a good good image was obtained after high moistening storage of the charging roller. It was confirmed that the characteristics of the charging roller could be stably maintained for a long period of time even under a high-humidity condition.

Example 5

A layer of an EPDM compound composed as shown below was extrusion-molded around a stainless steel core having a diameter of 6 mm and having a conductive primer previously applied to its surface so that the outside diameter was 15 mm. The EDPM compound layer was vulcanized and foamed by being left in a 150° C. atmosphere for 1 hour, and the surface was thereafter polished. A conductive foam roller having an outside diameter of 12 mm was thereby formed.

The EPDM compound was composed of 100 parts by weight of EPDM, 6 parts by weight of conductive carbon black, 40 parts by weight of paraffine oil, 5 parts by weight of zinc oxide, 1 part by weight of a higher fatty acid, 2 parts by weight of sulfur, 1 part by weight of vulcanization accelerator CBS, 1 part by weight of vulcanization accelerator TMTD, 0.5 part by weight of vulcanization accelerator ZnBDC, 7 parts by weight of a foaming agent, and 5 parts by weight of calcium oxide.

The purified methylolated nylon used in Example 1 was applied to a surface of this conductive foam layer to a thickness of 10 μm. A transfer roller having a surface layer formed of the methylolated nylon was thereby obtained.

This coating material was applied to the rubber roller by dipping application to form a nylon surface layer having a thickness of 10 μm. The roller with the surface layer was thereafter dried by being left in a 120° C. atmosphere for 1 hour. A charging roller having a surface layer formed of the purified methylolated nylon was thereby obtained.

This charging roller was mounted at a transfer roller position in a laser beam printer (commercial name: laser shot A4, a product from Canon) and was operated in such a manner that the transfer roller was brought into contact with a photosensitive drum with a contact pressure of 600 g at each of the opposite sides, and a DC 2.5 kV bias voltage was applied to the metallic core portion of the transfer roller. Images thereby printed on first to 1,000 sheets were evaluated. Good images were obtained. Good images were also obtained after the transfer roller had been maintained in a high moistening condition and in contact with the photosensitive drum. It was confirmed that the characteristics of the transfer roller could be stably maintained for a long period of time even under a high-humidity condition.

Comparative Example 3

A charging roller was formed and tested in the same manner as Example 5 except that the content of components having a molecular weight of 1,000 or less in the purified methylolated polyamide was 0.60 wt %. Charging was thereby performed stably with respect to first to 1,000 sheets. However, it was found that, in some images formed after high moistening storage of the charging roller, a line corresponding to the charging roller contact position was formed and the image quality was considerably reduced.

Example 6

Methylolated nylon was purified by a method described below.

50 g of methylolated nylon was immersed in a solvent formed of a mixture of 2,000 g of methanol and 3,000 g of MEK and was left for 24 hours, followed by filtration. A solid material thereby obtained was sufficiently washed with MEK and was dried, thereby obtaining purified methylolated nylon.

A charging roller was formed and tested in the same manner as Example 1 except for using the purified methylolated nylon obtained by this method. Charging was performed stably with respect to first to 1,000. Images formed after high moistening storage were examined. A line was formed on initial five sheets only in the case of an image pattern having alternate black and white portions, but no line was observed from the sixth sheet. This image defect was recognized as allowable in practice.

The molecular weight of the nylon used to form the surface layer was measured. It was found that the content of components having a molecular weight of 1,000 or less was 0.44 wt % while the methylolated nylon having an average molecular weight of 40,000 existed as a main component.

Comparative Example 4

A charging roller was formed and tested in the same manner as Example 6 except that the content of components having a molecular weight of 1,000 or less in the purified methylolated polyamide was 0.75 wt %. Charging was thereby performed stably with respect to first to 1,000 sheets. However, it was found that, in some images formed after high moistening storage of the charging roller, a line corresponding to the charging roller contact position was formed and the image quality was considerably reduced.

What is claimed is:

1. A charging member for charging a charged member by being brought into contact with the charged member, said charging member comprising a surface layer, wherein the content of components having a molecular weight of 1,000 or less in a resin forming said surface layer is 0.5 wt % or less.

2. A charging member according to claim 1, wherein the resin forming the surface layer of said charging member is formed of at least one resin selected from the group consisting of polyurethane resins, acrylic resins, polyester resins, fluorine resins and a polyamide resins.

3. A charging member according to claim 1, wherein said charging member has the shape of a roller.

4. A charging member according to claim 1, wherein said charging member has the shape of a flat plate.

5. A charging member according to claim 1, wherein the content of components having a molecular weight of 1,000 or less in a resin forming said surface layer is 0.44% or less.

6. A charging member according to claim 1, wherein the content of components having a molecular weight of 1,000 or less in a resin forming said surface layer is 0.27% or less.

7. A charging member according to claim 1, 5 or 6, wherein the percentage of the content of components is a value before the charging member is used.

8. An unit capable of being detachably attached to a body of an apparatus, said unit comprising:

a charging member having a surface layer;

a photosensitive member; and at least one of development means and cleaning means supported integrally with said charging member and said photosensitive member;

wherein the content of components having a molecular weight of 1,000 or less in a resin forming said surface layer is 0.5 wt % or less.

9. A unit according to claim 8, wherein the content of components having a molecular weight of 1,000 or less in a resin forming said surface layer is 0.44% or less.

10. A unit according to claim 8, wherein the content of components having a molecular weight of 1,000 or less in a resin forming said surface layer is 0.27% or less.

11. A unit according to claims 8, 9 or 10, wherein the percentage of the content of components is a value before the charging member is used.

12. An electrophotographic apparatus comprising:

a photosensitive member;

latent image forming means;

means for developing a formed latent image;

means for transferring the developed image to a transfer member; and at least one of a first charging member for supplying charge to said latent image forming means, and a second charging member for effecting transfer charging;

wherein the content of components having a molecular weight of 1,000 or less in a resin forming a surface layer on at least one of said first and second charging members is 0.5 wt % or less.

13. An apparatus according to claim 12, wherein the content of components having a molecular weight of 1,000 or less in a resin forming said surface layer is 0.44% or less.

14. An apparatus according to claim 12, wherein the content of components having a molecular weight of 1,000 or less in a resin forming said surface layer is 0.27% or less.

15. An apparatus according to claim 12, 13 or 14, wherein the percentage of the content of the components is a value before the charging member is used.

16. A charging member for charging a charged member by being brought into contact with the charged member, said charging member comprising a surface layer, wherein the content of components having a molecular weight of 1,000 or less in the resin forming the surface layer of said charging member is 0.3 wt % or less.

17. An unit capable of being detachably attached to a body of an apparatus, said unit comprising:

a charging member having a surface layer;

a photosensitive member; and at least one of development means and cleaning means supported integrally with said charging member and said photosensitive member;

wherein the content of components having a molecular weight of 1,000 or less in the resin forming the surface layer of said charging member is 0.3 wt % or less.

18. An electrophotographic apparatus comprising: a photosensitive member;

latent image forming means;

means for developing a formed latent image;

means for transferring the developed image to a transfer member; and at least one of a first charging member for supplying charge to said latent image forming means, and a second charging member for effecting transfer charging;

wherein the content of components having a molecular weight of 1,000 or less in a resin forming said surface layer is 0.3 wt % or less.

* * * * *

UNITED STATES PATENT AND TRADEMARK OFFICE

CERTIFICATE OF CORRECTION

PATENT NO. : 5,363,176

DATED : November 8, 1994

INVENTOR(S) : Yuzi Ishihara, et al.

It is certified that error appears in the above-identified patent and that said Letters Patent is hereby corrected as shown below:

COLUMN 1

Line 24, "member to be charged" should read --charging member-- and "charged member" should read --member to be charged--;

Line 44, "surface" should read --surface layer--; and

Line 62, "member" should read --member to the surface will occur, however,--.

COLUMN 2

Line 14, "a charging member" should be deleted; and
Line 64, "polubutyl" should read --polybutyl--.

COLUMN 3

Line 62, "member" should read --member (member to be charged)--.

COLUMN 4

Line 19, "spring, not shown" should read --spring (not shown),--; and

Line 57, "undergo" should read --to undergo--.

UNITED STATES PATENT AND TRADEMARK OFFICE

CERTIFICATE OF CORRECTION

PATENT NO. : 5,363,176

DATED : November 8, 1994

INVENTOR(S) : Yuzi Ishihara, et al.

It is certified that error appears in the above-identified patent and that said Letters Patent is hereby corrected as shown below:

COLUMN 8

Line 8, "1,000" should read --1,000 sheets--;
Line 38, "to" should read --to the first--; and
Line 59, "dimehylformamide" should read --dimethylformamide--.

COLUMN 9

Line 64, "EDPM" should read --EPDM--.

COLUMN 12

Line 50, "comprising: a" should read --comprising:
a--.

Signed and Sealed this

Twenty-fifth Day of April, 1995

Bruce Lehman

*Attest:*

BRUCE LEHMAN

*Attesting Officer*

*Commissioner of Patents and Trademarks*